United States Patent [19]

Wildfang

[11] Patent Number: 4,470,546

[45] Date of Patent: Sep. 11, 1984

[54] SPRAY ADJUSTER FOR CONNECTION TO A FAUCET OR THE LIKE

[75] Inventor: Dieter Wildfang, Muellheim, Fed. Rep. of Germany

[73] Assignee: Dieter Wildfang KG, Muellheim, Fed. Rep. of Germany

[21] Appl. No.: 415,822

[22] Filed: Sep. 7, 1982

[30] Foreign Application Priority Data

Nov. 20, 1981 [DE] Fed. Rep. of Germany ... 8133875[U]

[51] Int. Cl.[3] ..... E03C 1/08

[52] U.S. Cl. ..... 239/428.5

[58] Field of Search ..... 239/428.5, 590.5, 553.3, 239/DIG. 18; 261/DIG. 22

[56] References Cited

U.S. PATENT DOCUMENTS

| | | | |
|---|---|---|---|
| 2,832,577 | 4/1958 | Goodrie et al. | 239/DIG. 18 |
| 3,334,818 | 8/1967 | Moen | 239/428.5 |
| 3,706,418 | 12/1972 | Hyde | 239/428.5 |
| 4,313,564 | 2/1982 | Shames et al. | 239/428.5 X |

*Primary Examiner*—John J. Love
*Assistant Examiner*—Mary F. McCarthy
*Attorney, Agent, or Firm*—Michael J. Striker

[57] ABSTRACT

Disclosed is a spray adjuster composed of a tubular housing in which a perforated flow dispersing member, a flow deflecting member having a bevelled buffer surface, and an aerating member with a sieve-like outlet are arranged. The bevelled deflecting surface of the deflecting member is inserted in a frustoconical recess in the dispersion member to form therewith an outwardly diverging annular passage including with a central axis of the housing an angle of about 45°. The inclined annular passage transits into a tubular annular passage which is coaxial with the housing, whereby a connection line of an inner edge between the bevelled surface and the cylindrical surface of the deflecting member and the outer edge of the cylindrical recess of the dispersion plate is aligned with the bevelled surface. In this manner, the operational noise of the spray adjuster is considerably reduced.

12 Claims, 3 Drawing Figures

SPRAY ADJUSTER FOR CONNECTION TO A FAUCET OR THE LIKE

BACKGROUND OF THE INVENTION

The present invention relates in general to spray regulators or aerators for use in connection with faucets and the like, and in particular to a spray regulator of the type which includes flow dispersing means cooperating with a flow deflecting member, aerating means including an air suction member and a sieve-like spray regulator communicating with the flow outlet; the flow deflecting member has a bevelled flow deflecting surface defining a flow breaking edge and forming with the flow dispersing member an annular passage which is inclined to the direction of flow.

Spray adjusters of this kind are known from prior art and serve for mixing a jet of a liquid discharged from the faucet with gas, in most cases water with air, and simultaneously producing a uniformly distributed spray. The spray regulators of this kind are used most frequently in connection with water faucets for wash basins in kitchens. Prior-art spray regulators, however, possess considerable disadvantages. For example, conventional spray regulators include flow dispersing components which effectively disperse the water jet but, in doing so, generate considerable noise.

Also known are spray regulators which operate relatively noiselessly, since they consist usually of only a flow dispersing perforated plate. Additional flow deflecting devices such as buffer plates and the like flow deflecting elements for the dispersed partial streams are missing. The resulting advantages of silent operation and of simple construction, however, are counterbalanced by impaired dispersion of the flow jet. Attempts have been made to avoid the latter disadvantage by the provision of an increased number of jet regulating sieves. For example, known are flow adjusters whose flow dispersing member consists substantially of a single perforated plate but including frequently five or six flow regulating sieves. Such an increased number of sieves, however, becomes susceptible to calcification and brings about the danger that the flow regulating passages are quickly reduced, thus impairing the function of the device.

In spray adjusters designed with buffer plates for achieving an improved flow deflection, one encounters again the aforementioned relatively large generation of noise. Attempts have been made to provide flow deflecting plates which are inclined relative to the direction of flow, so as to reduce the noise. Nevertheless, in such prior-art solutions the deflected flow has been directed again against a buffer body which is located substantially perpendicular to the direction of deflected flow, and consequently the noise level remained comparatively high.

SUMMARY OF THE INVENTION

It is therefore a general object of the present invention to overcome the aforementioned disadvantages.

More particularly, it is an object of the invention to provide an improved spray regulator which secures the advantages of prior-art regulators but which is not possessed of their disadvantages. That is, the spray adjuster according to this invention disperses effectively the liquid jet and at the same time operates relatively silently.

An additional object of this invention is to reduce operational and repair costs. A further object of the invention is to provide such an improved spray regulator which is assembled from easily replaceable component parts.

In keeping with these objects, and others which will become apparent hereafter, one feature of the invention resides, in a spray adjuster of the aforedescribed kind, in the provision of a flow dispersing member formed with a recess on its downstream surface, the recess having a cylindrical inner wall forming with the downstream surface an exit edge, and a frustoconical inner wall adjoining the cylindrical wall; a flow deflecting member formed with a flow deflecting bevelled surface and a cylindrical surface adjoining the bevelled surface at a flow breaking edge, the flow deflecting member being inserted in the recess, the frustoconical inner wall of the recess defining with the bevelled surface an outwardly diverging annular passage which is inclined relative to the center axis of the adjuster at an angle between 40° and 50°, preferably 45°, and a connection line between the exit edge and the flow breaking edge being substantially flush with the bevelled surface.

In contrast to prior-art flow dispersing effected exclusively by a flow deflecting plate, in the solution according to this invention there is provided an additional flow dispersion by means of flow breaking gaps resulting on the flow breaking edges of the annular passage. By virtue of the particular geometric arrangement of the exit edge and of the flow breaking edge, the flow dispersing effect is substantially increased. At the same time, in spite of the intensity of the flow dispersion the generation of noises is relatively low, inasmuch as, after the dispersion of the main jet into the partial jets, the latter impact on inclined deflecting surfaces.

In a flow dispersing member provided with flow dispersing perforations communicating with the recess, it is of advantage when the angle formed between the axes of the perforations and the bevelled surface of the deflecting member is between 40° and 50°, preferably 45°. In practice, it has been proved that noise generation at this particular range of inclination of the annular passage is particularly low. In spite of the low noise, the dispersion of the partial flow streams at the flow breaking edges is both very effective and noiseless.

In the preferred embodiment of this invention, the inclined annular passage formed between the inclined inner wall of the recess of the flow dispersing member and the bevelled surface of the flow deflecting member continuously diverges in the flow direction and communicates in the range of the flow breaking edge of the bevelled surface with a cylindrical passage which is concentric with the center axis of the adjuster. By this arrangement, the flow dispersion of respective partial jets upon their impact the deflecting surface is still improved.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
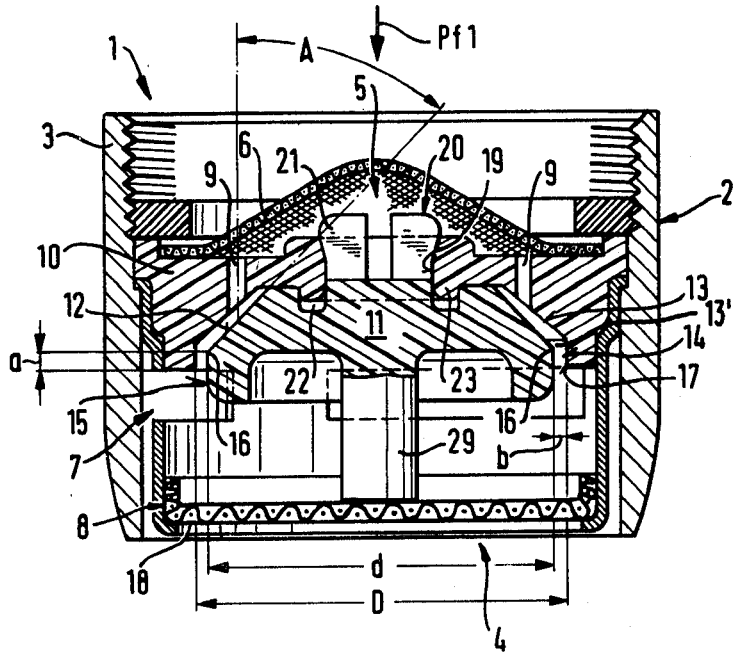
FIG. 1 is a sectional side view of a spray adjuster of this invention, shown on an enlarged scale.

A spray adjuster according to FIG. 1 includes a substantially tubular housing 2 formed with a connection orifice or inlet 3 and with a spray outlet orifice 4. Within the housing, there are consecutively arranged in flow direction indicated by arrow Pf1, a flow dispersing device 5 provided with an inlet sieve 6 protecting the interior of the adjuster against clogging by foreign particles. The flow dispersing device 5 cooperates with a flow deflecting member 11 and downstream of the flow deflecting member there is arranged an air suction device 7 and a sieve-like spray regulator 8.

The flow dispersing device 5 consists substantially of a dispersing plate 10 formed with perforations 9 and at its downstream surface with a recess having a frustoconical surface part 13 and a cylindrical surface part 14. The surfaces 13 and 14 adjoin each other at a flow breaking juncture 13' and the cylindrical surface part forms with the downstream surface of plate 10 an exit edge 17. In the recess 14, there is inserted a deflecting member 11 having a bevelled deflecting surface 12 which transits into a cylindrical surface 15 at a flow breaking edge 16. The annular flow guiding channel resulting between the surfaces 12 and 13 communicates with the flow dispersing perforations 9 and diverges outwardly toward the cylindrical exit channel between surfaces 14 and 15. The cylindrical channel part is substantially coaxial with the center axis of housing 2 and has a uniform cross section. The bevelled deflecting surface 12 of the member 11 forms with the center axis of respective perforations 9 an angle A between 40° and 50°, and preferably as illustrated in the example of FIG. 1 about 45°. This particular arrangement of the inclined guiding channel relative to the dispersing perforations contributes substantially in reducing the noise generation, and at the same time further disperses the partial streams emanating from the perforations 9.

The cylindrical channel portion between surfaces 14 and 15, due to the fact that the connection line between edges 16 and 17 coincides substantially with the inclined surface 12, further contributes to the noise reduction and to additional dispersion of the partial streams. Especially the exit edge 17, due to its arrangement relative to the inner flow breaking edge 16 of the deflecting member, acts as a particularly effective flow breaking gap, which at the same time generates only minute noise, so that the hitherto contradictory requirements, namely an effective flow dispersion and low noise generation, are met in a most advantageous manner. The construction cost of this solution is low, and in comparison with most prior-art regulators of this kind is even lower.

It is also of advantage when for the sake of good flow dispersion the spray regulator 8 is provided with a single sieve 18 of a coarse mesh size. Due to the possibility of using a single exit sieve 18 having large meshes, the danger of calcification is eliminated. The meshes of the sieve 18 preferably have sharp edges, in order to achieve a desired whirling at the break-off edges.

According to another feature of this invention, the ratio between the clearance b of the cylindrical channel portion between surfaces 15 and 14, to the spacing a between the edges 16 and 17 in the flow direction Pf1 is about in the range 1:1 to 1:3. The axial spacing a is preferably in the range between 0.5 mm and 1.5 mm, preferably about 0.65 mm. The outer diameter d of the flow deflecting body 11 in this example is 14.5 mm and the inner diameter D of the recess in the dispersion plate 10 is 15.5 mm.

Figure 2:
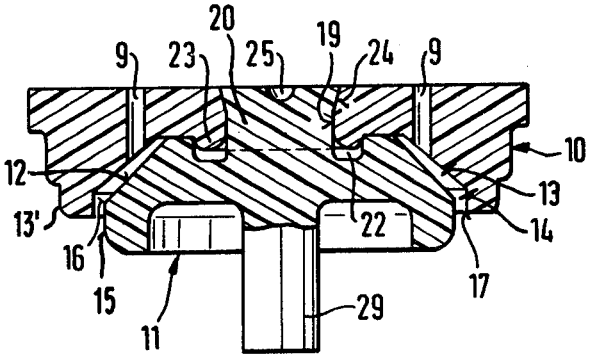
FIG. 2 is a sectional side view of a flow dispersing member in connection with a flow deflecting member according to FIG. 1.
Figure 3:
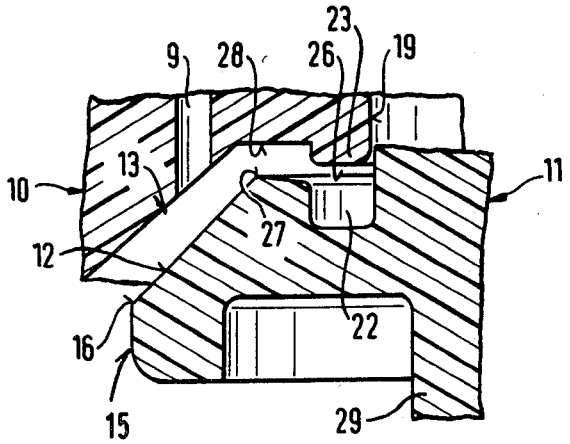
FIG. 3 is a sectional side view of a cut away part of the elements according to FIG. 2, shown in a disassembled condition.

Preferably, the flow dispersing body 10 and the flow deflecting member 11 are provided with interlocking means which either snugly fit with each other (FIG. 1) or are positively locked in position with each other (FIGS. 2 and 3). For this purpose, according to FIG. 1 the bottom part of the recess in the dispersion plate 10 is provided with a central bore 19 and the corresponding central parts of the deflecting member 11 is formed with a matching projection 20. By providing the projection 20 with a resilient, radially extended arresting head 21, the dispersion plate 10 and the deflecting member 11 can be firmly connected to each other so that any vibrations, and thus additional sources of noise, are eliminated. Preferably, in order to center the position of this connection, an annular groove 22 is formed around the connecting projection 20 and a corresponding annular flange 23 is provided in the dispersion plate 10 opposite the groove 22.

In the modification of the embodiment of this invention according to FIG. 2, the bore 19 in the dispersion plate 10 has at its end remote from the deflecting body 11 a chamfering 24 for engaging a slightly expanding conical end of the locking projection 20 in the deflecting body. This form-locking connection of the projection 20, in the case of solid material of the latter, can be achieved by compressing material of the projection in the central region thereof, as indicated by a recess 25 in FIG. 2. The resulting permanent connection of the parts 11 and 10 further contributes to the reduction of noise. The annular area of the smaller base of the deflecting member 11 and the annular part of the bottom of the recess in the dispersion plate 10 contact each other in the locked operative position of these two members and close the inner end of the inclined annular channel between the surfaces 12 and 13. It is advantageous when one of the abutting angular areas, for example area 26 of the deflecting member 11 in its disengaged position is slightly slanted toward the center of the member 11, so that upon axial insertion of the deflecting member 11 against the flat bottom portion 28 of the dispersing plate 10, the raised edge 27 first engages the latter, whereas the sloping surface 26 engages the bottom part 28 at least partially with a resilient bias when the two members are compressed together into their locked operative position. In this manner, a particularly tight seal and strong seat is ensured.

Referring again to FIG. 1, it will be seen that the side of the deflecting member 11 opposite the locking projection 20 is provided with a supporting pin 29 extending in the flow direction as far as to the regulating sieve 18, thus holding the sieve in a stable position. It will also be mentioned that the dispersing perforations 9, which in this example are in the form of axially directed passages, open into the inclined annular channel between surfaces 12 and 13 approximately in a range which is spaced apart from the closed end thereof about one-third of the total length of the slanted channel.

It will be understood that each of the elements described above, or two or more together, may also find a useful application in other types of constructions differing from the types described above.

While the invention has been illustrated and described as embodied in specific examples of spray adjusters for use in connection with a water faucet, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

I claim:

1. A spray adjuster for use in connection with a faucet or the like, comprising a tubular housing defining a center axis, an inlet and an outlet and, consecutively arranged in the housing in the direction of flow from the inlet to the outlet, a flow dispersing member formed with a recess on its downstream surface, said recess having a cylindrical inner wall portion forming with said downstream surface an exit edge, and a frustoconical inner wall portion adjoining the cylindrical wall portion forming a flow breaking juncture; a flow deflecting member formed with a flow deflecting bevelled surface and a cylindrical surface adjoining the bevelled surface at a flow breaking edge, said flow deflecting member being inserted in said recess, said frustoconical inner wall portion of the recess defining with the bevelled surface an outwardly diverging annular passage which is inclined relative to said center axis at an angle between 40° and 50°, and a connection line between said exit edge and said flow breaking edge being substantially flush with said bevelled surface; an aerating member including air suction means and sieve-like spray regulating means communicating with the outlet of said housing; and said flow dispersing member including a plurality of dispersing perforations directed parallel to said center axis and communicating with said inclined annular passage.

2. A spray adjuster as defined in claim 1, wherein said flow dispersing member and said flow deflecting member include means for connecting the two members together.

3. A spray adjuster as defined in claim 2, wherein said connecting means include a central bore formed in said flow dispersing member and a matching projection formed in said deflecting member, said projection snugly fitting into said bore.

4. A spray adjuster as defined in claim 3, wherein said connecting means further include an annular groove surrounding said matching projection of the deflecting member and a flange formed in said dispersing member around said central bore to fit into said annular groove.

5. A spray adjuster as defined in claim 4, wherein said connecting means include contact areas formed on said dispersing and deflecting members, one of said contact areas being slightly slanted relative to the other area to contact the latter at a resilient bias.

6. A spray adjuster as defined in claim 1, wherein said flow breaking edge of said deflecting member is closer to the downstream surface of said flow dispersing member than the juncture between the frustoconical and cylindrical inner walls of said dispersing member.

7. A spray adjuster as defined in claim 6, wherein the height of the cylindrical surface of said deflecting member is greater than that of inner cylindrical wall of said flow dispersing member.

8. A spray adjuster as defined in claim 1, wherein said aerating means include a single sieve of a coarse mesh size.

9. A spray adjuster as defined in claim 1, wherein said perforations open into said inclined annular passage in a region spaced from the upstream end of the latter about one-third of the entire length of the passage.

10. A spray adjuster as defined in claim 1, wherein said flow breaking and exit edges have sharp tips.

11. A spray adjuster as defined in claim 1, wherein the clearance of said cylindrical surface of the annular passage relative to the axial distance between the exit and flow breaking edges is at a ratio in the range of about 1:1 to 1:3, whereby the clearance is between 0.5 mm and 1.5 mm, preferably 0.65 mm and the outer diameter of the cylindrical surface of the deflecting member is 14.5 mm and the inner diameter of the cylindrical inner wall of the recess of the dispersion member is about 15.5 mm.

12. A spray adjuster as defined in claim 1, wherein said deflecting member is formed with a pin projecting in the direction of flow against the sieve-like spray regulator to keep the same in a fixed position.

* * * * *